United States Patent [19]

Martin et al.

[11] Patent Number: 4,821,325

[45] Date of Patent: Apr. 11, 1989

[54] ENDPOINT DETECTOR

[75] Inventors: Thomas B. Martin, Montville; Lawrence R. Rabiner, Berkeley Heights; Jay G. Wilpon, Warren, all of N.J.

[73] Assignee: American Telephone and Telegraph Company, AT&T Bell Laboratories, Murray Hill, N.J.

[21] Appl. No.: 669,654

[22] Filed: Nov. 8, 1984

[51] Int. Cl.[4] ..... G10L 5/00

[52] U.S. Cl. ..... 381/46; 381/41

[58] Field of Search ..... 381/41–46

[56] References Cited

U.S. PATENT DOCUMENTS

| | | | |
|---|---|---|---|
| 3,619,509 | 11/1971 | Barger et al. | 381/41 |
| 3,679,830 | 7/1972 | Uffelman et al. | 381/41 |
| 3,909,532 | 9/1975 | Rabiner | 381/41 |
| 4,032,710 | 6/1977 | Martin | 381/41 |
| 4,357,491 | 11/1982 | Daaboul | 381/46 |
| 4,370,521 | 1/1983 | Johnston | 381/41 |

OTHER PUBLICATIONS

"An Algorithm for Determining the Endpoints of Isolated Utterances", *The Bell System Technical Journal,* vol. 54, No. 2, Feb. 1975, pp. 297–315.

*Primary Examiner*—Emanuel S. Kemeny
*Assistant Examiner*—David D. Knepper
*Attorney, Agent, or Firm*—Wilford L. Wisner

[57] ABSTRACT

An arrangement for endpoint detection improves speech recognition accuracy where the input signal includes nonstationary noise. Energy pulses are found by looking for local energy level peaks, then analyzing surrounding energy levels to determine pulse boundaries. Energy pulses are combined according to predetermined criteria to form longer pulses corresponding to words or phrases in the input signal.

14 Claims, 7 Drawing Sheets

ENDPOINT DETECTOR

BACKGROUND OF THE INVENTION

Our invention relates to automatic speech recognition, and more particularly, to arrangements for detecting the endpoints or boundaries of the speech portion of an input signal.

An automatic speech recognizer identifies an unknown spoken utterance by matching an input signal which corresponds to the unknown utterance, to reference template signals which correspond to known utterances. The reference template which matches best is selected as the identity of the unknown utterance. The reference templates typically include only information-bearing or speech portions. On the other hand, in many commercially important environments, the input signal often includes both speech and nonspeech sounds. An input signal from the switched telephone network, for example, may have clicks, pops, tones and other background noise.

Whereas human listeners are comparatively tolerant of noise and distortion, current machine recognizers generally are not. Accurate location of the beginning and ending, the "endpoints" of spoken words and phrases, is thus important for reliable and robust automatic speech recognition. The endpoint detection problem is relatively less complex for high level speech signals in a low level, stationary noise environment, for example, where the signal-to-noise ratio is greater than about 30 dB. The problem is considerably more difficult, however, if the speech signal level is low relative to the background noise, or if the level and spectral content of the background noise is nonstationary. Such conditions may be encountered in the switched telephone network, especially in the long distance network, due to transmission line characteristics and transients in line signal generators.

In a prior endpoint detector, disclosed in U.S. Pat. No. 4,370,521, issued Jan. 25, 1983 to Johnston et al. and assigned to the present assignee, an input signal interval which contains speech is divided into a sequence of time frames. The energy level of the signal in each time frame is computed. Responsive to the energy levels, one or more energy pulses are identified over the signal interval. Each energy pulse consists of a group of contiguous time frames which correspond to a potential speech portion of the input signal. For example, an input signal interval containing the spoken words "one eight" ideally yields three distinct energy pulses: the first corresponding to the voiced portion "one"; the second corresponding to the voiced portion "eigh"; and the third corresponding to the unvoiced portion "t".

Next, certain of the raw energy pulses are "combined", that is, the constituent frames of two or more adjacent energy pulses are grouped together to form a longer energy pulse. In the above example, the second and third energy pulses may be combined to form a single energy pulse corresponding to "eight". Finally, the endpoints of the energy pulses remaining after the combining steps are passed to a speech recognizer.

In more detail, the identification of the raw energy pulses according to Johnston proceeds as follows. The energy levels are considered frame by frame in temporal sequence. If the energy level rises above a first threshold, and then above a second threshold before falling below the first threshold, the frame in which the energy level first rose above the first threshold is designated as the beginning frame of an energy pulse. Subsequently, the first frame in which the energy level falls below a third threshold is designated as the ending frame of the energy pulse. This process is repeated over the remainder of the input signal interval whereby a plurality of energy pulses may be detected.

The Johnston arrangement attempts to find endpoints based on the energy of speech rising above the energy of the background noise. This may be conveniently characterized as a "bottom-up" approach. The bottom-up endpoint detector works well where the background noise is stationary. Where the level and spectral content of the background noise fluctuates, however, the bottom-up detector may be less effective.

It is thus an object of the invention to provide an endpoint detector which improves the accuracy of a speech recognizer where the input signal include nonstationary noise.

SUMMARY OF THE INVENTION

We have discovered that the endpoints of information bearing portions of an input signal which includes nonstationary noise can be reliably detected by finding the high energy frame in local regions of the input signal and then analyzing the energy values of frames surrounding the local high energy frames to define energy pulse boundaries. This may be characterized as a "top-down" approach.

An interval of speech is divided into time frames. The frame having the maximum energy level over the interval is selected. The first frame preceding the maximum energy level frame which has an energy level below a threshold is defined as the beginning frame of an energy pulse. The first frame following the maximum energy level frame which has an energy level below a threshold is defined as the ending frame of the energy pulse. The process is repeated, excluding in each repetition frames that became energy pulse constituents in a prior repetition, until the entire interval has been considered.

DETAILED DESCRIPTION

Figure 1:
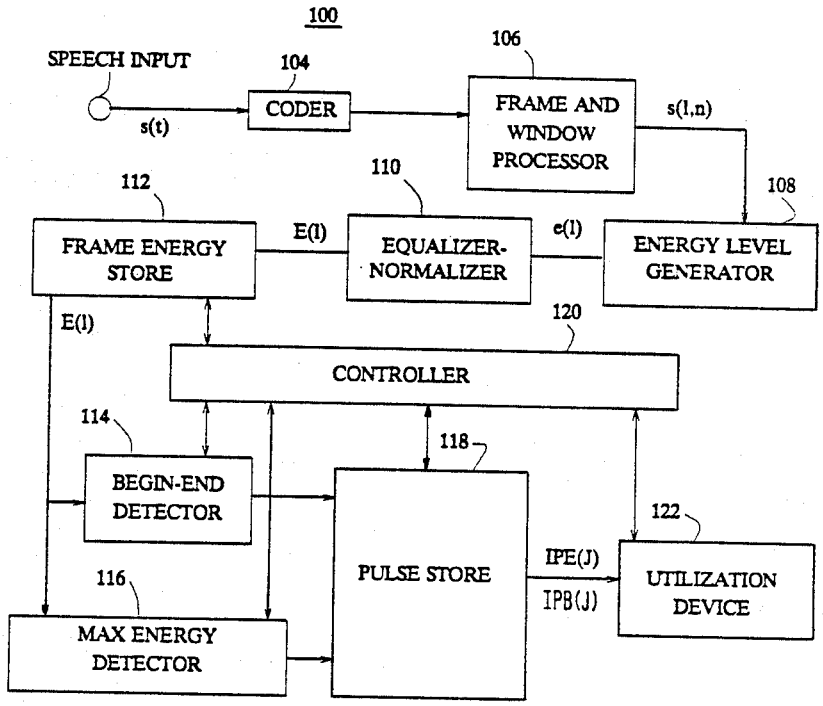
FIG. 1 shows a general block diagram of an endpoint detector in accordance with the invention.

FIG. 1 shows a general block diagram of a top-down endpoint detector in accordance with the invention. The system of FIG. 1 may be used to provide the beginning and ending points of the information-bearing components of an input signal to a utilization device, such as a speech recognizer. The endpoint detector may comprise a programmed general purpose digital computer such as the MV8000 made by Data General Incorporated. Alternatively, the endpoint detector may be implemented with special purpose digital hardware, as is well known in the art.

Referring to FIG. 1, an interval of an input signal s(t) which includes speech is applied to the input of coder 104. In coder 104 the input signal is first bandpass filtered and sampled. If the input signal is a telephone bandwidth signal, for example, the input signal is bandpass filtered from 100 Hz to 3200 Hz and sampled at 6.67 kHz. The sampled speech is then quantized and converted to digital form. The digitized speech from coder 104 is applied to frame and window processor 106. There, the digitized speech is preemphasized using a simple first-order digital filter with a z-transform:

$$H(z)=1-az^{-1} \quad (1)$$

where a=0.95. The digitized signal interval is then blocked into frames of N samples, with a shift or overlap between frames of L samples. N may be, for example, 300 samples and L may be 100 samples. This translates to a frame duration of 45 milliseconds with a 15 millisecond shift between frames. Each frame may then be weighted by a Hamming window of the form:

$$w(n)=0.54-46\cos(2\pi n/N),\quad 0\leqq n\leqq N-1. \quad (2)$$

The output of frame and window processor 106 is a preemphasized, windowed signal s(l,n) wherein the index l denotes the frame, the frames ranging from 0 to L−1. The index n denotes the particular sample within a frame, wherein n ranges from 0 to N−1.

The windowed signals s(l,n) are applied to energy level generator 108. Generator 108 forms signals e(1) representative of the energy in each frame of the windowed signal:

$$e(1)=10\log R(1)0,\quad 1=1,2\ldots NF \quad (3)$$

where NF is the total number of frames in the input signal interval, and R(1)0 is the zero'th order correlation coefficient:

$$R(1)0=\sum_{n=0}^{N-1}[s(1,n)]^2. \quad (4)$$

The output signal e(1) from energy level generator 108 is applied to equalizer-normalizer 110. Unit 110 performs adaptive level equalization to compensate for the mean background noise level. The member of e(1), where 1=1,NF, having the minimum value, e(min), is subtracted from each member e(1) to yield, enorm(1), a normalized energy level array:

$$\text{enorm}(1)=e(1)-e(\min),\quad 1=1,NF. \quad (5)$$

A second normalization is performed in unit 110 to obtain the energy level signal E(1):

$$E(1)=\text{enorm}(1)-\text{MODE} \quad (6)$$

where MODE is the mode of a histogram of the lowest NP values of E(1). NP may be, for example, 15.

Further background information with respect to coder 104, frame and window processor 106, energy level generator 108 and equalizer-normalizer 110 may be found in U.S. Pat. No. 4,370,521, Johnston et al., herein incorporated by reference.

The energy level signals E(1) from equalizer-normalizer 110 are collected in frame energy store 112. Responsive to controller 120, all of the energy level signals E(1), 1=1,NF, are applied to maximum energy detector 116. Detector 116 finds the frame with the maximum energy over all frames in the input interval. Next, the energy level signals E(1) of frames surrounding the maximum energy frame are applied to begin-end detector 114. Detector 114 finds the first frame prior to the maximum energy frame which has an energy level less than a threshold K1. Threshold K1 may be, for example, 3 dB. Detector 114 then finds the first frame following the maximum energy frame which has an energy level less than a threshold K3. Threshold K3 may be, for example, 5 dB. At this point, a set of possible beginning and ending frames for an energy pulse has been found. These endpoints are applied from detector 114 along with the maximum energy frame from detector 116 to pulse store 118.

Controller 120 next checks the first IT1 frames and last IT2 frames of the pulse for consistently low energy content which indicates breath noise. IT1 and IT2 may be, for example, 5 frames. Any low energy frames are eliminated by adjusting the endpoints in store 118. Then the adjusted energy pulse is tested to guarantee that its duration is greater than a minimum length threshold and that its maximum energy level frame is above a minimum level. The pulse is considered invalid if either test is failed.

Controller 120 repeats the preceding steps starting with the next highest energy level frame over the input interval. All frames in previously detected pulses are eliminated from consideration in the current iteration. The process is complete when all frames over the input interval have been considered.

Controller 120 next applies a pulse combiner algorithm to the energy pulses in store 118. The algorithm attempts to combine two or more adjacent pulses to form longer pulses. The first current pulse is the pulse having the highest peak energy frame of all the pulses in store 118. The first pulse preceding the current pulse is combined with the current pulse if the downward slope DS over the last IGAP frames of the preceding pulse is greater than a threshold and if the last frame of the preceding pulse is within NFW frames of the first frame of the current pulse. IGAP may be, for example, 3 frames. NFW may be set adaptively according to the value of DS. Similarly, the first pulse following the current pulse is combined with the current pulse if the downward slope of the current pulse is greater than a threshold and if the following pulse is within NFW frames of the current pulse. Other pulse combining restrictions may be applied as would now be apparent to those skilled in the art. For example, the duration of any combined pulse may be constrained to be less than a predetermined maximum. Also, an upward slope minimum value could be imposed.

The above process is repeated with the current pulse being the pulse which has the next highest peak energy frame of the pulses in store 118. The process terminates when all possible pulses have been considered. The final output to utilization device 122 is the beginning and ending frames IPB(J) and IPE(J) for each energy pulse.

A program for implementing the instant endpoint detector invention may be structured, for example, in accordance with flow charts 200–1000 in FIGS. 2–10. In particular, flow charts 200–600 show a detailed example of finding the beginning and ending frames which define an energy pulse. Flow charts 700–900 show a detailed example of combining the raw energy pulses to form longer energy pulses.

Figure 2:
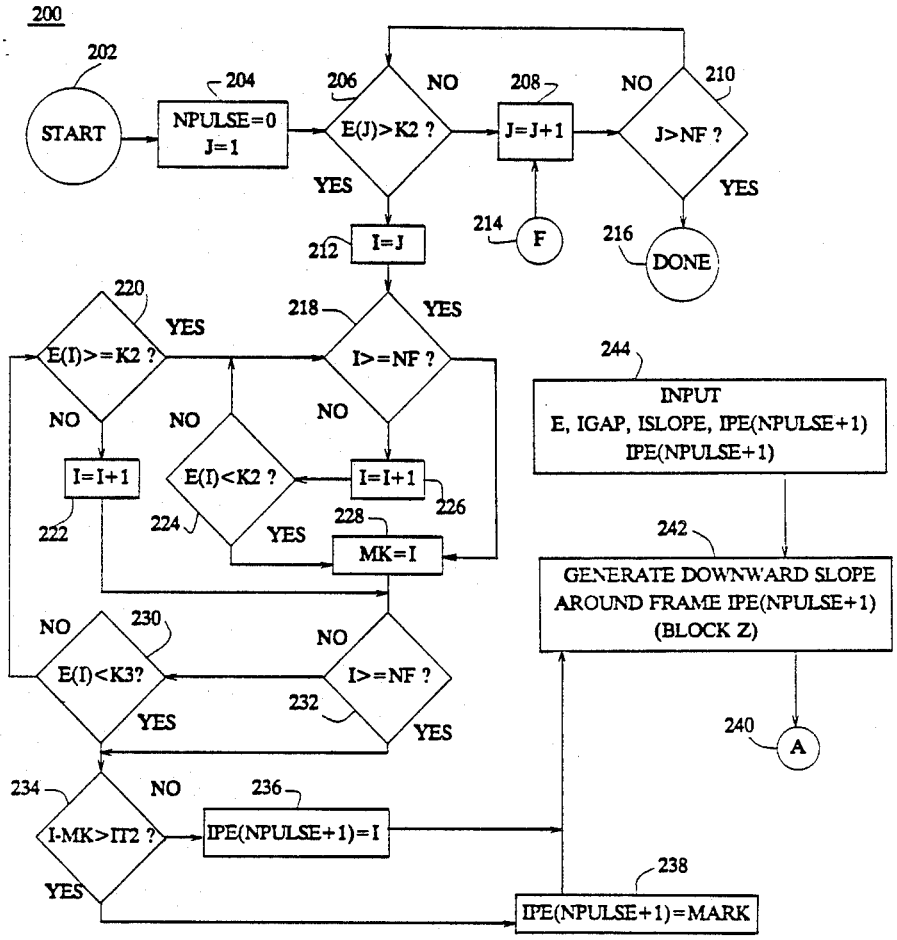
FIGS. 2–10 show flow charts of endpoint detection in accordance with the invention.

Referring to FIG. 2, energy pulse detection starts (202) with pulse counter NPULSE=0 and frame counter J=1 (204). If the frame energy level E(J) is less than or equal to threshold K2 (206), J is incremented by 1 (208). If J is greater than the number of frames NF in the interval (210), the process terminates (216). If J is less than or equal to NF, E(J) is again compared to K2. If E(J) is greater than K2 (206), frame counter I is set equal to J (212). If I is less than NF (218), I is incremented by 1 (226). If E(I) is greater than or equal to K2 (224), the process returns to test whether I is greater than or equal to NF (218). If E(I) is less than K2 (224), mark counter MK is set to I (228). If I is less than NF (232), and E(I) is less than threshold K3 (230), and E(I) is greater than or equal to K2 (220), the process returns to test I (218). If E(I) is less than K2 (220), I is incremented (222) and the process returns to test I (232). If I is greater than or equal to NF (232) or if E(I) is less than K3 (230), and if I minus MK is greater than slope parameter IT slope center frame IPE(NPULSE+1) is set to MARK(238). If I minus MK is less, than or equal to IT2 (234), IPE(NPULSE+1) is set to I (236). The outputs of blocks 236 and 238 are connected to control downward slope generation in block 242. The values of E, IGAP, ISLOPE and IPE (244) are provided to generate the downward slope (242). The slope generation is shown in block Z, FIG. 5.

Figure 5:
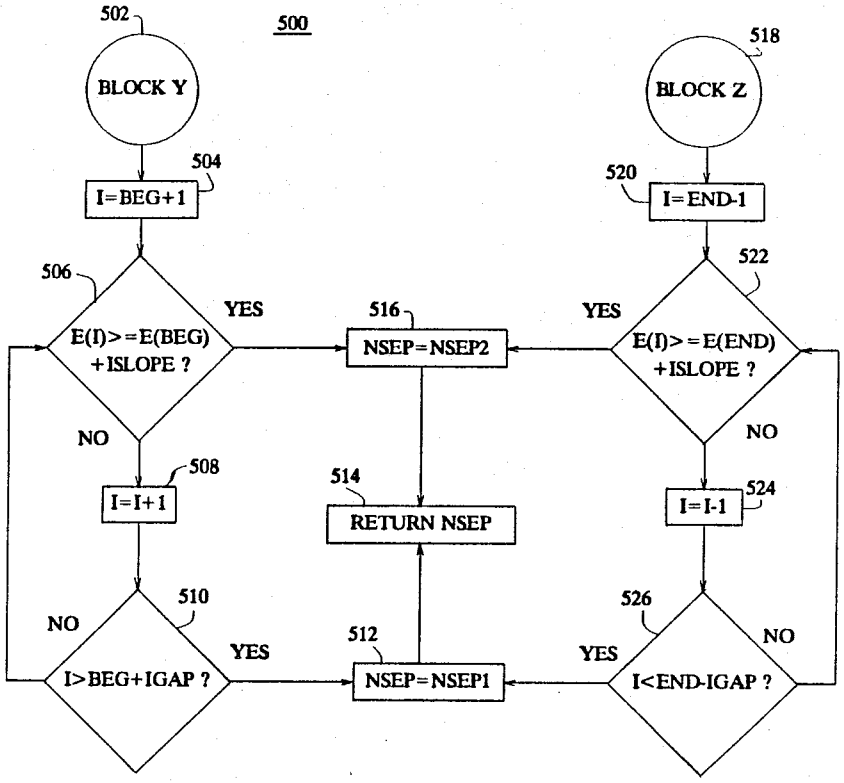

Referring to FIG. 5, in block Z (518), I is set to END minus 1 (520). If E(I) is greater than or equal to E(END) plus ISLOPE (522), NSEP is set to NSEP2 (516) and the subroutine returns the value of NSEP (514). If E(I) is less than E(END) plus ISLOPE (522), I is decremented (524). If I is greater than or equal to END minus IGAP (526), the process returns to test E(I) (522). If I is less than END minus IGAP (526), NSEP is set to NSEP1 (512) and the subroutine returns NSEP (514).

Figure 3:
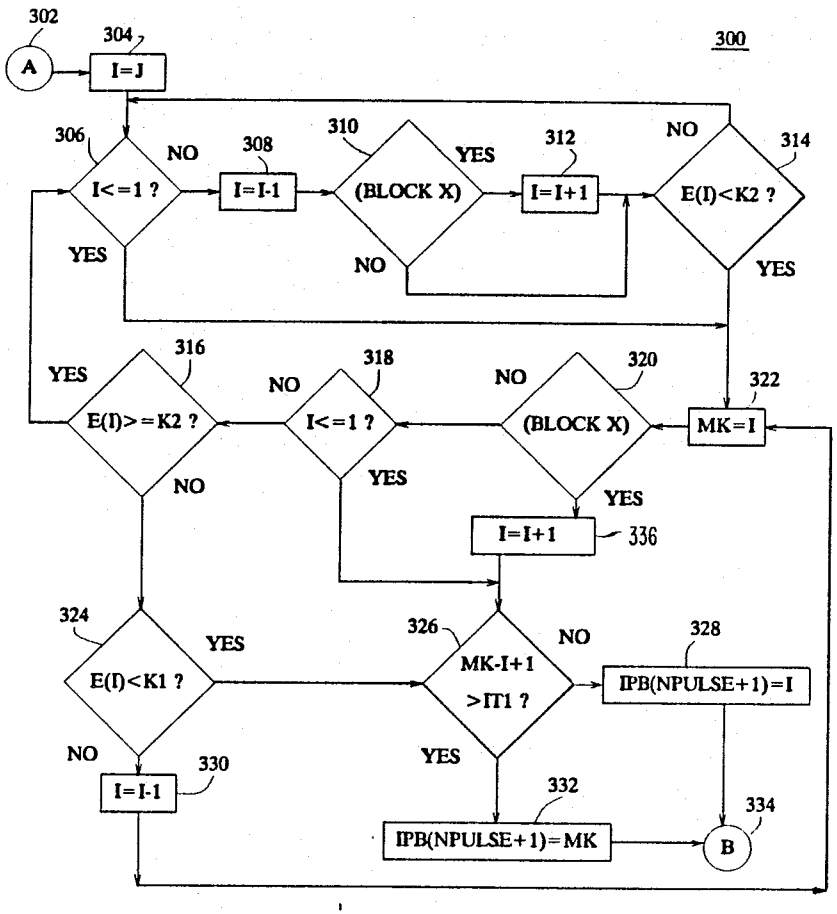

Referring to FIG. 3, which is joined at connector A (302) to FIG. 2 connector A (240), I is set equal to J (304). If I is greater than 1 (306), I is decremented (308) and the subroutine block X is performed (310).

Figure 6:
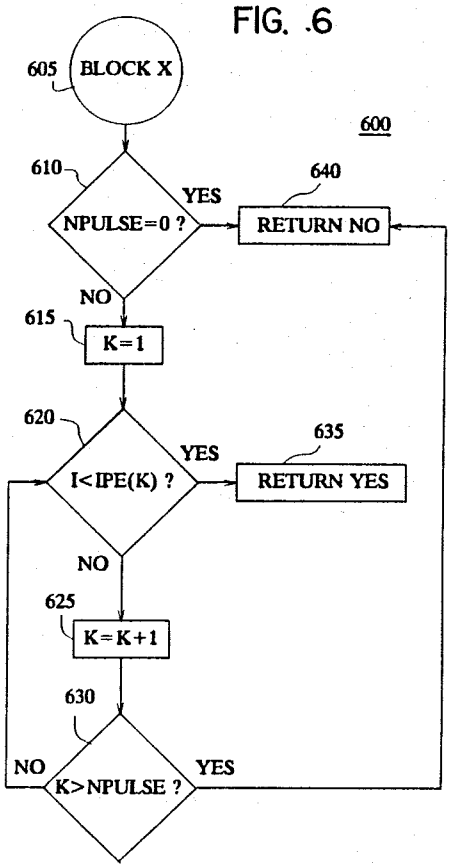

Referring to the block X subroutine (605) in FIG. 6, if NPULSE is equal to 0 (610), block X returns a "NO" value (640). If NPULSE is not 0 (610), K is set to 1 (615). If I is less than IPE(K) (620), block X returns a "YES" value (635). If I is greater than or equal to IPE(K) (620), K is incremented (625). If K is greater than NPULSE (630), the subroutine returns "NO" (640). If K is less than or equal to NPULSE, the test on I is repeated (620).

Returning to FIG. 3, I is incremented (312) only if the block X subroutine returns a "YES" (310). If E(I) is greater than or equal to K2(314), the test on I is repeated (306). If I is less than or equal to 1, or if E(I) is less than K2 (314), MK is set to I (322). If the block X subroutine returns "NO" (320), and if I is greater than to 1 (318), and if E(I) is greater than or equal to K2 (316), the process returns to test I (306). If block X returns "YES" (320), I is incremented (336). If MK minus I plus 1 is greater than IT1 (326), IPB(NPULSE+1) is set to MK (332); otherwise IPB(NPULSE+1) is set to I (328). If block X returns "NO" (320) and I is less than or equal to 1 (318), or if I is greater than 1 (318), and E(I) is less than K2 (316) and K1 (324), the test on MK minus minud I plus 1 is run (326). If E(I) is greater than or equal to K1 (324), I is decremented (330) and MK is set to I (322). The outputs of both blocks 328 and 332 flow into point B, which is the same as point B of FIG. 4.

Figure 4:
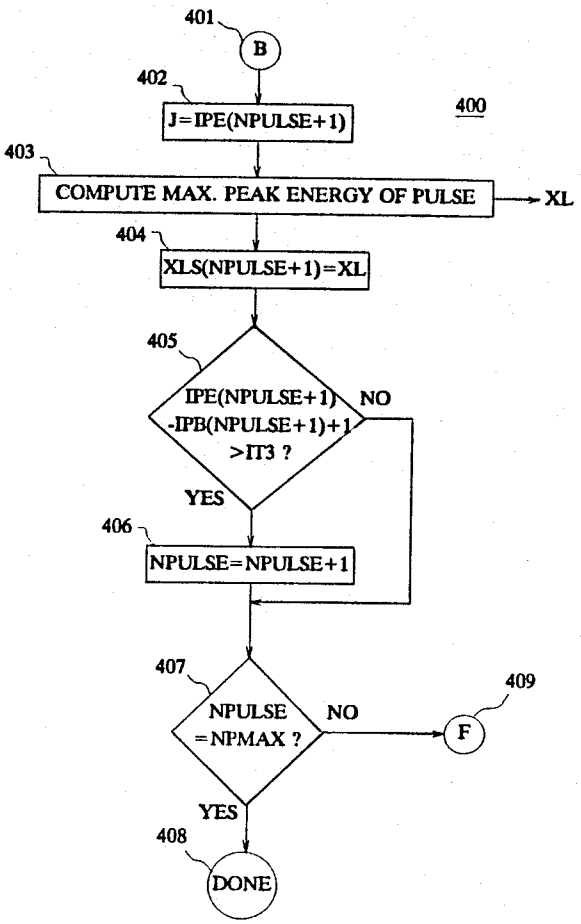

Referring to FIG. 4, which is joined at connector B (401) to connector B (334) in FIG. 3, J is set to IPE(NPULSE+1) (402). The maximum peak energy of the pulse is computed and output as XL (403). XLS(NPULSE+1) is set to XL (404). If IPE(NPULSE+1) minus IPB(NPULSE+1) plus 1 is greater than IT3 (405), then NPULSE is incremented (406); otherwise NPULSE remains the same. If NPULSE is equal to the maximum pulse number NPMAX (407), the process terminate (408); otherwise the process repeats as shown by connector F (409) which joins to connector F (214) in FIG. 2.

Figure 7:
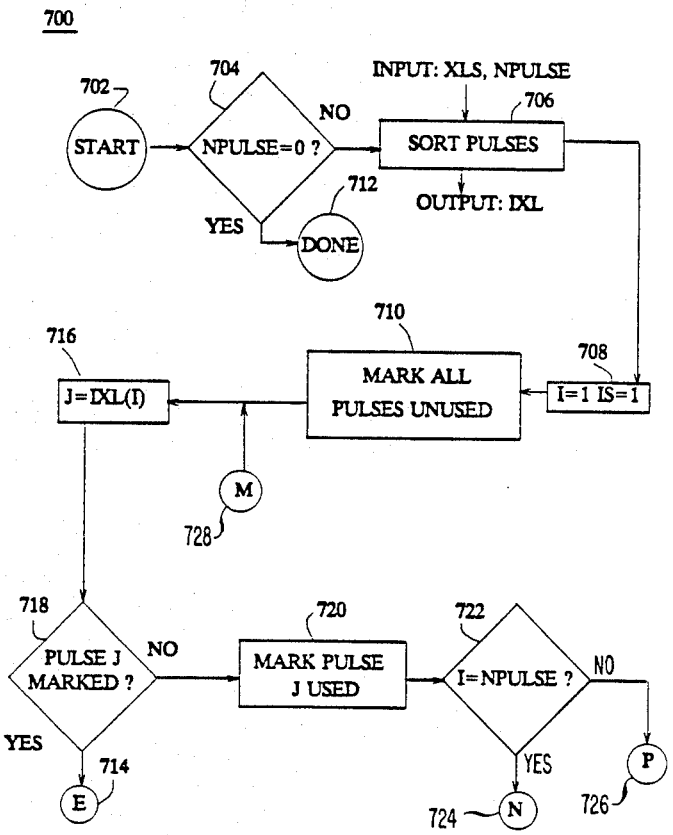

Referring to FIG. 7, the pulse combiner process begins (702) by testing the number of pulses NPULSE is equal to 0 (704). If NPULSE is 0, the process terminates (712). If NPULSE is greater than 0, the maximum energy XLS for each of the NPULSE pulses are sorted in order of decreasing peak energy (706). The output IXL is the index of the pulse with the highest peak energy. Next, I and IS are set to 1 (708). All pulses are initially marked as unused (710). J is set to IXL(I) (716). If pulse J is not currently marked (718), pulse J is marked used (720). If I is not equal to NPULSE(722), the process continues in FIG. 8, as shown by connector P (726) in FIG. 7 and connector P (856) in FIG. 8.

Figure 8:
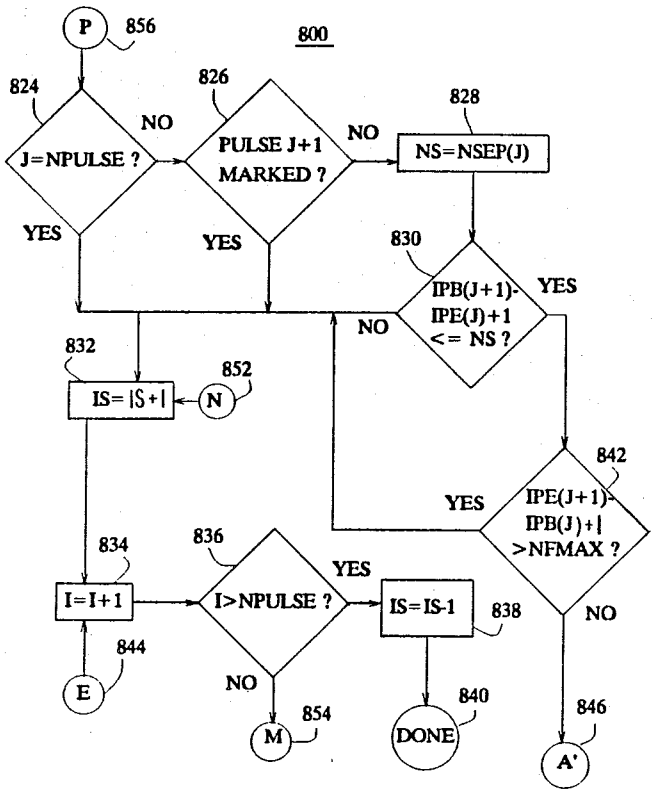

Referring to FIG. 8, if J is not equal to NPULSE (824), and pulse J+1 is not marked (826), NS is set to NSEP(J) (828). If J is equal to NPULSE (824), or if pulse J+1 is marked (826), or if IPB(J+1) minus IPE(J) plus 1 is greater than NS (830), IS is incremented (832) and I is incremented (834). If I is greater than NPULSE (836), IS is decremented (838) and the process terminates (840). If IPB(J+1) minus IPE(J) (940) plus 1 is less than or equal to NS (830), and if IPE(J+1) minus IPB(J) plus 1 is greater than NFMAX (842), IS is incremented (832). If IPE(J+1) minus IPB(J) plus 1 is less than or equal to NFMAX (842), the process continues in FIG. 9, as shown by connector A' (846) in FIG. 8 and connector A' (905) in FIG. 9.

Figure 9:
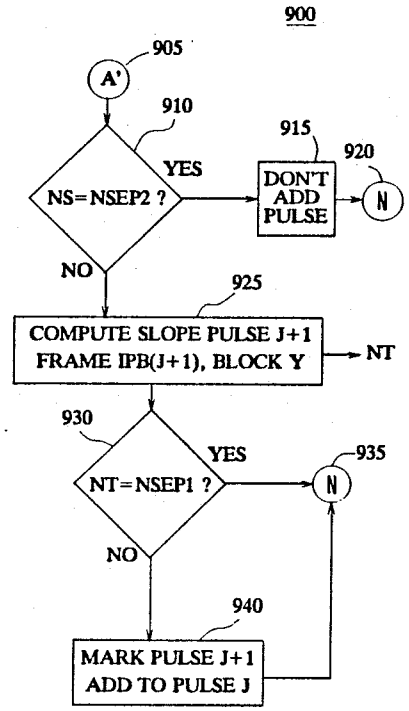

Referring to FIG. 9, if NS equals NSEP2 (910), the pulses are not combined (915), and the process continues in FIG. 8, as shown by connector N (920) in FIG. 9 and connector N (852) in FIG. 8. If NS does not equal NSEP2 (910), the upward slope NT of pulse J+1 is computed around frame IPB (J+1) (925) by subroutine block Y, as shown in FIG. 5.

Referring to FIG. 5, in block Y (502), I is set to BEG plus 1 (504). If E(I) is greater than or equal to E(BEG) plus ISLOPE (506), NSEP is set to NSEP2 (516) and returned (514). If E(I) is less than E(BEG) plus ISLOPE (506), I is incremented (508). If I is less than or equal to BEG plus IGAP (510), the test on E(I) is performed (506). If I is greater than BEG plus IGAP (510), NSEP is set to NSEP1 (512) and returned (514).

Returning to FIG. 9, if upward slope NT is equal to NSEP1 (930), the process continues in FIG. 8, as shown by connector N (852) in FIG. 8. If NT is not equal to NSEP1 (930), pulse J+1 is marked and combined with pulse J. The process continues as above in FIG. 8 (935).

Returning to FIG. 8, if I is less than or equal to NPULSE (836), the process continues in FIG. 7, as shown by connector M (854) in FIG. 8 and connector M (728) in FIG. 7. In FIG. 7, if pulse J is marked (718), the process continues in FIG. 8, as shown by connector E (714) in FIG. 7 and connector E (844) in FIG. 8.

Figure 10:
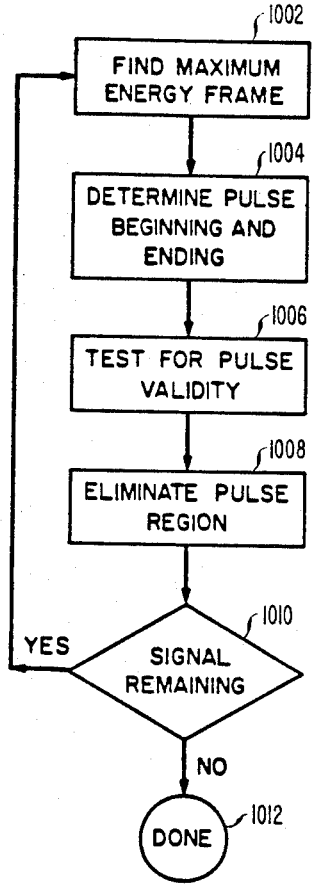

FIG. 10 is a flow chart showing the top-down approach to energy pulse detection in accordance with the invention. First, the maximum energy frame over the interval is found (1002). Surrounding frames are examined to determine the beginning and ending frames of a pulse (1004). The pulse is checked for validity (1006). Frames comprising the pulse are eliminated from further consideration (1008). If any frames remain in the interval (1010), the above process is repeated, otherwise the process terminates (1012).

While the invention has been shown and described with reference to a preferred embodiment, various modifications may be made by those skilled in the art without departing from the spirit and scope of the invention. Additional decision rules may be incorporated that reflect the characteristics of a specialized vocabulary. For example, if only digit strings are to be detected, only two words, the digits 6 and 8, may contain a stop gap; all other digits can be represented by a single energy pulse with no other pulses attached. Also, for the digits 6 and 8, the maximum energy pulse is always the first pulse when a secondary pulse is added. This further implies that no pulse should be added to precede a maximum energy pulse. Further, digits 6 and 8 have at most only one stop gap, implying that at most one pulse can be added to follow a maximum energy pulse. In addition, any of the aforementioned thresholds may be dynamically determined, instead of being fixed values. For example, energy threshold K3 may be set responsive to the average signal energy over a prior time period.

What is claimed is:

1. A method of identifying the endpoints of one or more utterances in an interval of speech comprising the steps of (1a) dividing the interval into a succession of time frames, each frame having an identifying pointer, (1b) selecting the frame over the interval which has the maximum speech energy level, (1c) defining the first frame preceding the selected energy frame which has an energy level below a first threshold as the beginning frame of an energy pulse, (1d) defining the first frame following the selected energy frame which has an energy level below a second threshold as the ending frame of the energy pulse, (1e) saving the pointers of the beginning and ending frame and the level of the selected energy frame of the energy pulse if the number of frames between the beginning and ending frame is greater than a predetermined number and the level of the selected energy frame is greater than a third threshold, (1f) repeating steps (1b)–(1e), examining only those frames which are not constituents of the current or prior energy pulses until no further energy pulses are found, whereby the saved pointers correspond to the end points of the utterances in the interval, whereby the endpoint determinations are likely to be more effective in the presence of varying background noise than in the prior art.

2. The method of claim 1 further comprising after step (1c)

designating the frame which follows the current beginning frame by a predetermined number of frames as the new beginning frame it the energy level in each of a predetermined number of frames following the current beginning frame is below a fourth threshold.

3. The method of claim 1 further comprising after step (1d)

designating the frame which precedes the current ending frame by a predetermined number of frames as the new ending frame is the energy level in each of a predetermined number of frames preceding the current ending frame is below a fifth threshold.

4. The method of claim 1 further comprising after step (1f)

combining the energy pulses according to predetermined criteria, and saving the pointers of the beginning and ending frames of the combined energy pulses.

5. The method of claim 4 wherein the energy pulse combining step comprises (5a) selecting the energy pulse over the interval which has the maximum energy level, (5b) combining the selected energy pulse with the immediately preceding energy pulse;

(5c) determining: if the slope of the energy level over a predetermined number of frames before the ending frame of the preceding energy pulse is greater than a predetermined threshold, and if the slope of the energy level over a predetermined number of frames after the beginning frame of the current selected energy pulse is greater than a predetermined value, and if the number of frames between the ending frame of the preceding energy pulse and the beginning frame of the current selected energy pulse is less than a predetermined number;

(5d) then, when all the conditions of (5c) are satisfied, defining the current combined energy pulse as a new energy pulse, eliminating the current selected energy pulse and immediately preceding energy pulse from further consideration, and repeating steps (5a)–(5d);

(5e) then, when any of the conditions of (5c) are not satisfied, terminating the combining step;

(5f) then, when the current new energy pulse has been thus defined selecting the energy pulse which has the next highest energy level, and (5g) repeating steps (5a)–(5g), as if this next level were the maximum energy level until all energy pulses that were found have been selected or combined.

6. The method of claim 4 wherein the energy pulse combining step comprises (6a) selecting the energy pulse over the interval which has the maximum energy level, (6b) combining the selected energy pulse with the immediately succeeding energy pulse;

(6c) determining: if the slope of the energy level over a predetermined number of frames after the beginning frame of the succeeding energy pulse is greater than a sixth threshold, and if the slope of the energy level over a predetermined number of frames before the ending frame of the current selected energy pulse is greater than a seventh threshold, and if the number of frames between the ending frame of the succeeding energy pulse and the ending frame of the current selected energy pulse is less than a predetermined number;

(6d) then, when all of the conditions of (6c) are satisfied, defining the current combined energy pulse as a new energy pulse, eliminating the current selected energy pulse and immediately succeeding energy pulse from further consideration, and repeating steps (6a)–(6d);

(6e) then, when any of the conditions of (6c) are not satisfied, terminating the combining step;

(6f) then, when the current new energy pulse has been thus defined selecting the energy pulse which has the next highest energy level, (6g) repeating steps (6a)–(6g), as if this next level were the maximum energy level until all energy pulses that were found has been selected or combined.

7. The method of claim 4 wherein the energy pulse combining step comprises (7a) selecting the energy pulse over the interval which has the maximum energy level, (7b) combining the selected energy pulse with the immediately adjacent energy pulse to either side thereof;

(7c) determining: if the slope of the energy level over a predetermined number of frames receding from the nearest frame of and receding within the adjacent energy pulse is greater than a sixth threshold, and if the slope of the energy level over a predetermined number of frames receding from the nearest frame of and receding within the current selected energy pulse is greater than a seventh threshold, and if the number of frames between the nearest frame of the adjacent energy pulse and the nearest frame of the current selected energy pulse is less than a predetermined number;

(7d) then, when all the conditions of (7c) are satisfied, defining the current combined energy pulse, as a new energy pulse, eliminating the current selected energy pulse and the immediately adjacent energy pulse from the further consideration, and repeating steps (7a)–(7d);

(7e) then, when all the conditions of (7c) are not satisfied for a pulse to the first side of the selected pulse, terminating combining to said first side;

(7f) combining the current combined energy pulse, if any, or the current selected energy pulse, with the immediately adjacent energy pulses to the second side thereof;

(7g) then, determining: if the slope of the energy level over a predetermined number of frames receding from the nearest frame of and receding within the adjacent energy pulse is greater than a sixth threshold, and if the slope of the energy level over a predetermined number of frames receding from the nearest frame of and receding within the current combined energy pulse or the current selected energy pulse is greater than a seventh threshold, and if the number of frames between the nearest frame of the adjacent energy pulse and the nearest frame of the current combined energy pulse or the current selected energy pulse is less than a predetermined number;

(7h) then, when all of the conditions of (7g) are satisfied, defining the current combined energy pulse as a new energy pulse, eliminating the current selected energy pulse, and the immediately adjacent energy pulse from further consideration, and repeating steps (7f)–(7h);

(7i) then, when any of the conditions of (7g) are not satisfied, terminating the combining step;

(7j) then, when a new energy pulse has been thus defined, selecting the energy pulse which has the next highest energy level, and repeating steps (7a-)–(7c) as if this next energy level were the maximum energy level until all energy pulses that were found have been selected or combined.

8. Apparatus for identifying the endpoints of one or more utterances in an interval of speech comprising (8a) means for dividing the interval into a succession of time frames, each frame having an identifying pointer, (8b) means for selecting the frame over the interval which has the maximum speech energy level, (8c) means for defining the first frame preceding the selected energy frame which has an energy level below a first threshold as the beginning frame of an energy pulse, (8d) means for defining the first frame following the selected energy frame which has an energy level below a second threshold as the ending frame of the energy pulse, (8e) means for saving the pointers of the beginning and ending frames and the level of the selected energy frame of the energy pulse if the number of frames between the beginning and ending frame is greater than a predetermined number, and the level of the selected energy frame is greater than a third threshold, and (8f) means for controlling means (8b)–(8e) to repeat processing on only those frames which are not constituents of current or prior energy pulses until no further energy pulses are found, whereby the saved pointers correspond to the endpoints of the utterances in the interval and the endpoints are likely to be more effectively determined in the presence of varying background noise than in the prior art.

9. The apparatus of claim 8 wherein the means (8c) for defining the first frame preceding the selected energy frame which has an energy level below a first threshold further comprises means for designating the frame which follows the current beginning frame by a predetermined number of frames as the new beginning frame if the energy level in each of a predetermined number of frames following the current beginning frame is below a fourth threshold.

10. The apparatus of claim 8 wherein the means (8d) for defining the first frame following the selected energy frame which has an energy level below a second threshold as the ending frame of the energy pulse further comprises means for designating the frame which precedes the current ending frame by a predetermined number of frames the new ending frame if the energy level in each of a predetermined number of frames preceding the current ending frame is below a fifth threshold.

11. The method of claim 8 further comprising after step (8f)

means for combining the energy pulses according to predetermined criteria, and means for saving the pointers of the beginning and ending frames of the combined energy pulses.

12. The apparatus of claim 11 wherein the energy pulse combining means comprises (12a) means for selecting the energy pulse over the interval which has the maximum energy level, (12b) means for combining the selected energy pulse with the immediately preceding energy pulse;

(12c) means for determining: if the slope of the energy level over a predetermined number of frames before the ending frame of the preceding energy pulse is greater than a sixth threshold, and if the slope of the energy level over a predetermined number of frames after the beginning frame of the current selected energy pulse is greater than a seventh threshold, and if the number of frames between the ending frame of the preceding energy pulse and the beginning frame of the current selected energy pulse is less than a predetermined number;

(12d) means responsive to a positive output from the determining means for defining the current combined energy pulse as a new energy pulse, eliminating the current selected energy pulse and immediately preceding energy pulse from further consideration, and means for controlling means (12a-)-(12d) to repeat operation thereof;

(12e) means responsive to a non-positive output from the determining means for terminating the repetition of operation by means (12a)-(12d), (12f) means responsive to such termination by the terminating means for selecting the energy pulse which has the next highest energy level, and (12g) means for controlling means (12a)-(12g) to repeat operation thereof as if this next level were the maximum energy level until all energy pulses that were found have been selected or combined.

13. The apparatus of claim 11 wherein the energy pulse combining means comprises (13a) means for selecting the energy pulse over the interval which has the maximum energy level, (13b) means for combining the selected energy pulse with the immediately succeeding energy pulse;

(13c) means for determining: if the slope of the energy level over a predetermined number of frames after the beginning frame of the succeeding energy pulse is greater than a sixth threshold, and if the slope of the energy level over a predetermined number of frames before the ending frame of the current selected energy pulse is greater than a seventh threshold, and if the number of frames between the ending frame of the succeeding energy pulse and the ending frame of the current selected energy pulse is less than a predetermined number;

(13d) means responsive to a positive output from the determining means for defining the current combined energy pulse as a new energy pulse, eliminating the current selected energy pulse and immediately succeeding energy pulse from further consideration, and controlling means (13a)-(13d) to repeat operation thereof;

(13e) means responsive to a non-positive output from the determining means for terminating the repetition of operation by means (13a)-(13d);

(13f) means responsive to such termination by the terminating means for selecting the energy pulse which has the next highest energy level, and (13g) means for controlling means (13a)-(13g) to repeat operation thereof as if this next level were the maximum energy level until all energy pulses that were found have been selected or combined.

14. The apparatus of claim 11 wherein the energy pulse combining means comprises (14a) means for selecting the energy pulse over the interval which has the maximum energy level, (14b) means for combining the selected energy pulse with the immediately adjacent energy pulse to either side thereof;

(14c) means for determining: if the slope of the energy level over a predetermined number of frames receding from the nearest frame of and receding within the adjacent energy pulse is greater than a sixth threshold, and if the slope of the energy level over a predetermined number of frames receding from the nearest frame of and receding within the current selected energy pulse is greater than a seventh threshold, and if the number of frames between the nearest frame of the adjacent energy pulse and the nearest frame of the current selected energy pulse is less than a predetermined number;

(14d) means responsive to a positive output from the determining means for defining the current combined energy pulse, as a new energy pulse, eliminating the current selected energy pulse and the immediately adjacent energy pulse from further consideration and for controlling means (14a-)-(14d) to repeat operation thereof;

(14e) means responsive to a non-positive output from the determining means for a pulse to the first side of the selected pulse for terminating the operation of the combining means for pulses to said first side;

(14f) means for combining the current combined energy pulses, if any, or the current selected energy pulse, with the immediately adjacent energy pulse to the second side thereof;

(14g) means for controlling the operation of the determining means to determine if the slope of the energy level over a predetermined number of frames receding from the nearest frame of and receding within the adjacent energy pulse is greater than a sixth threshold; and if the slope of the energy level over a predetermined number of frames receding from the nearest frame of and receding within the current combined energy pulse or the current selected energy pulse is greater than a seventh threshold, and if the number of frames between the nearest frame of the adjacent energy pulse and the nearest frame of the current combined energy pulse or the current selected energy pulse is less than a predetermined number;

(14h) means responsive to a positive output from the determining means for an energy pulse to the second side of the current combined energy pulse for defining the current combined energy pulse as a new energy pulse, eliminating the current combined energy pulse, and the immediately adjacent energy pulse from further consideration, and controlling means (14a)-(14h) to repeat operation thereof;

(14i) means responsive to a non-positive output from the determining means for an energy pulse to the second side of the current combined energy pulse for terminating the operation of the combining means;

(14j) means responsive to the operation of the last said terminating means for selecting the energy pulse which has the next highest energy level, and for controlling means (14a)-(14j) as if this next energy level were the maximum energy level until all energy pulses that were found have been selected or combined.

* * * * *